US005233724A

United States Patent [19]

Lei tert et al.

[11] Patent Number: 5,233,724

[45] Date of Patent: Aug. 10, 1993

[54] CUSHIONED STOP MEMBER FOR SLIDING PANEL

[75] Inventors: Andre T. Lei tert, Brampton; Stephen J. Hughes, Scarborough, both of Canada

[73] Assignee: Stanley Acmetrack Limited, Ontario, Canada

[21] Appl. No.: 770,934

[22] Filed: Oct. 4, 1991

[51] Int. Cl.[5] ..... E05F 5/06

[52] U.S. Cl. ..... 16/86 A; 160/202; 160/197; 16/86 B

[58] Field of Search ..... 16/83, 86 A, 86 R, 86 B, 16/DIG. 20; 160/197, 202, 211, 216, 222; 49/125, 410; 267/139, 140, 152; 248/345.1

[56] References Cited

U.S. PATENT DOCUMENTS

| | | | |
|---|---|---|---|
| 1,097,300 | 5/1914 | Carlson . | |
| 1,340,621 | 5/1920 | Miers | 16/86 A |
| 1,542,813 | 6/1925 | Atwood | 16/86 A |
| 1,657,314 | 1/1928 | Mitchell | 16/86 B |
| 1,884,835 | 10/1932 | Perry | 16/86 R |
| 2,466,913 | 4/1949 | Rogers | 160/224 |
| 2,833,346 | 5/1958 | Preston | 160/197 |
| 2,850,089 | 9/1958 | Burke | 160/202 |
| 2,895,183 | 7/1959 | Dumbolton | 49/410 |
| 2,908,051 | 10/1959 | Sparkes . | |
| 3,100,916 | 8/1963 | McKinney | 49/125 |
| 3,439,950 | 4/1969 | Kunevicius | 267/140 |
| 4,107,878 | 8/1978 | Baus | 49/125 |
| 4,115,953 | 9/1978 | Brosenius | 49/125 |
| 4,218,807 | 8/1980 | Snow | 16/86 A |

FOREIGN PATENT DOCUMENTS 1192360 8/1985 Canada .

*Primary Examiner*—Lowell A. Larson
*Assistant Examiner*—Donald M. Gurley
*Attorney, Agent, or Firm*—Beveridge, DeGrandi, Weilacher & Young

[57] ABSTRACT

A cushioned stop member is provided for attachment to a sliding panel for limiting movement of that panel relative to opposed abutment surfaces on a similar panel; this allows a series of sliding panels to be used in self aligning manner. The stop member has a base part with a flat surface suitable for securement to a flat surface of the sliding panel and retaining elements projecting outwardly from the base part. These retaining elements hold a resilient cushioning member which is an interference fit on the retaining elements and which has opposed side surfaces which can engage on the opposed abutment surfaces of the other panel in a cushioned manner.

3 Claims, 1 Drawing Sheet

CUSHIONED STOP MEMBER FOR SLIDING PANEL

BACKGROUND OF THE INVENTION

This invention relates to a cushioned stop member for a sliding panel assembly especially of the type having three or more sliding panels. Such assemblies are used on closet doors and room partitions. Usually, the sliding panels have interlocking flanges or stop members which limit movement of one panel relative to another so that a closet door for example can be completely opened or closed by moving only the outer panel. Such constructions are shown for example in the following U.S. patents:

2,850,089 issued Sep. 2, 1958 to Burke
2,908,051 issued Oct. 13, 1959 to Sparkes
4,107,878 issued Aug. 22, 1978 to Baus With such prior art arrangements, there is an impact between the flanges or stop members which may be noisy and possibly damaging if the panels are moved too quickly. The cushioning stop member of this invention allows the panels to engage each other without noise and with less risk of damage.

SUMMARY OF THE INVENTION

According to the present invention, a cushioned stop member for attachment to a sliding panel for limiting movement of that panel relative to opposed abutment surfaces on an adjacent panel comprises a base part having a flat surface suitable for securement to a flat surface of the sliding panel, and retaining means projecting outwardly from the base part. A resilient cushioning member is formed as an interference fit on the retaining means, and has opposed side surfaces extending generally perpendicularly to the panel flat surface and which can engage in a cushioned manner on the opposed abutment surfaces to limit relative movement of the two panels. Preferably, the base part and retaining means are integrally formed of sheet metal, the retaining means comprising flange elements extending outwardly from opposite edges of the base part and terminating in inwardly extending wing parts which engage in slots in the cushioning member.

BRIEF DESCRIPTION OF THE DRAWINGS

The invention will be further described with reference to the accompanying drawings which show a preferred embodiment of the invention, and in which.

DESCRIPTION OF THE PREFERRED EMBODIMENT

Figure 1:
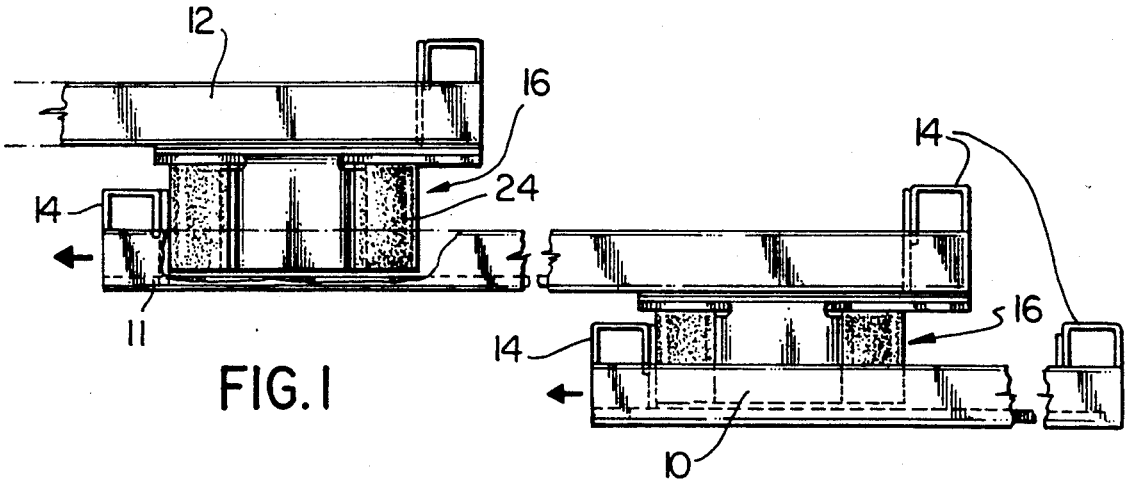
FIG. 1 is a top view of a three part sliding door assembly for a closet, using a stop member in accordance with the invention.

As shown in FIG. 1, the closet door assembly comprises three sliding panels namely an outer panel 10, an intermediate panel 11, and an inner panel 12. Each panel is identical except that only the inner and intermediate panels are provided with a stop member 16, in accordance with the invention, as shown. The panel moves by means of conventional tracks, with rollers at the bottom of the panel, and hanger members at the top; such rollers and hanger members can be connected to the panel for example by connectors as shown in U.S. Pat. No. 3,750,337 which issued to Acme General Corp.

Each of the panels except the outer panel, i.e. each of panels 11 and 12, has a stop member 16, in accordance with the invention, secured adjacent an outer edge of the panel and in approximately a mid position vertically. This stop member protrudes from the face of the front panel sufficiently far to engage on the insides of opposed inwardly projecting flanges 14 of the next outer panel, so that for example the folding door can be opened by merely sliding the outer panel so that its trailing flange picks up the intermediate panel after it has moved an appropriate distance.

Figure 2:
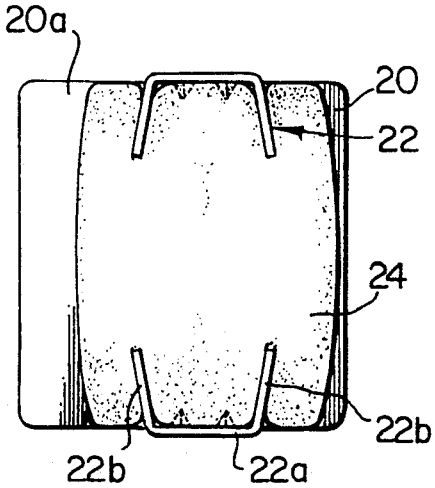
FIG. 2 is a front view of the stop member.
Figure 3:
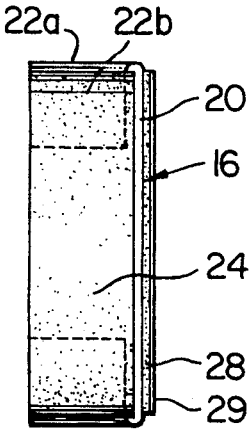
FIG. 3 is a side view of the stop member.
Figure 4:
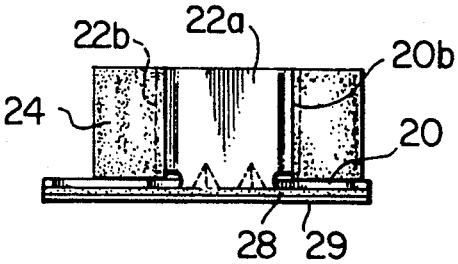
FIG. 4 is a top view of the stop member.

As shown in FIGS. 2–4, the stop member comprises a base part 20, from which protrudes retaining means 22, which engage a foam rubber cushioning part 24 as a friction fit.

The base part 20 and retaining means 22 are formed from a single, initially flat piece of metal. The base part is a flat rectangular piece, and the retaining means include upper and lower flanges **22*a*, bent outwardly from the plane of the base part, the flanges each having two inwardly projecting wings 22*b* which form a U-shape with the flange part 22*a*. The wing parts 22*b* provide outwardly protruding plate-like retaining elements which frictionally engage in corresponding slots in the top and bottom of the cushion member 24. This latter member is generally rectangular but is bulged at its side surfaces, so that the foam rubber side surfaces can gently engage on the inside of flanges 14**.

It will be seen that construction of the stop member is very simple, and that the base and retaining means can be formed from flat metal with simple bending operations.

The bottom surface of base member 20 is adhered to the outer surface of the mirror panel through the intermediary of a relatively thin resilient layer 28, which is secured to the mirror surface by an adhesive 29. In the form supplied, the stop member would have a layer of release paper over the adhesive. The cushion layer 28 is provided in case of slight discrepancies of flatness of the base part 20 relative to the mirror surface.

Obviously, the means of securement to the door panel is a matter of choice, depending on the nature of the panel.

We claim:

1. A bi-directional stop member for limiting sliding movement of a first vertical panel relative to a second vertical panel, wherein the sliding movement is in a horizontal direction of movement, and the second panel has opposed abutment surfaces which face toward each other along said direction of movement, said stop member comprising:

a base part, disposed in a plane, having a flat surface for mounting the stop member on a flat vertical surface of said first vertical panel and having an upper and lower edge;

retaining means comprising a flange projecting perpendicularly from the upper and lower edges of said base part, a pair of plate-like retaining elements attached to each of said flanges and being disposed in planes transverse to the plane of said base part;

a resilient foam rubber cushioning member supported by said base part, said cushioning member having formed on opposite edges thereof vertically disposed abutment surfaces which face oppositely away from each other along said direction of movement so as to engage said opposed abutment surfaces of said second panel, said cushioning member having slot-like recesses formed therein receiving and frictionally engaging said pair of plate-like retaining elements, said recesses being located intermediate said oppositely facing abutment surfaces of said cushioning member such that said abutment surfaces of said cushioning member engage said abutment surfaces of said second panel in a gentle cushioned manner.

2. A bi-directional cushioned stop member according to claim 1 wherein said base part and said retaining means are integrally formed of sheet metal, said flanges being bent from opposed edges of said base part.

3. A stop member according to claim 1, wherein the base part has a cushioning layer on said flat surface, said cushioning layer being provided with an adhesive layer, the adhesive being suitable for securement to a mirror panel.

* * * * *